US005729864A

United States Patent [19]

Lie et al.

[11] Patent Number: 5,729,864

[45] Date of Patent: Mar. 24, 1998

[54] HAND GRIPPING DEVICE

[76] Inventors: Sun Ja Lie; Chang Ho Lie, both of 1430 Lady Bird Dr., McLean, Va. 22101

[21] Appl. No.: 706,567

[22] Filed: Sep. 5, 1996

[51] Int. Cl.[6] ..... A47B 95/02

[52] U.S. Cl. ..... 16/110 R; 16/111 R; 16/DIG. 12

[58] Field of Search ..... 16/111 R, 110 R, 16/114 R, DIG. 12, DIG. 19; 81/436, 177.1, 489; 76/106, 119; D8/107; D7/688, 691, 368, 369, 393, 395; 273/75, 73 R, 167, 168

[56] References Cited

U.S. PATENT DOCUMENTS

| | | | |
|---|---|---|---|
| D. 357,099 | 4/1995 | Sammons, Jr. | D8/107 |
| 375,773 | 1/1888 | Rockwell | D7/395 |
| 1,664,257 | 3/1928 | McCullough | 16/DIG. 12 |
| 2,200,626 | 5/1940 | Lamkin . | |
| 2,467,284 | 4/1949 | Williams | 16/110 R |
| 2,520,355 | 8/1950 | Bell | 16/111 R |
| 3,868,110 | 2/1975 | Jones . | |
| 4,174,109 | 11/1979 | Gaiser . | |
| 4,376,536 | 3/1983 | Martin | 16/111 R |
| 4,664,381 | 5/1987 | Aaron | D8/107 |
| 4,836,544 | 6/1989 | Lai . | |
| 4,934,024 | 6/1990 | Secton . | |
| 5,294,117 | 3/1994 | Huang . | |

OTHER PUBLICATIONS

Sinclair & Rush, Inc. Cat. May 1980.

*Primary Examiner*—Chuck Mah

[57] ABSTRACT

A hand gripping device for attachment to an implement, which comprises a hollow sleeve having at least one open end, the hollow sleeve having an inner surface which is adapted to conform to the implement and an outer surface, the outer surface having two peaks which extend from the sleeve which define a valley and a slope whereby when the sleeve is grasped by a hand. The little finger is held in the valley and the ring finger is held against the slope.

20 Claims, 1 Drawing Sheet

HAND GRIPPING DEVICE

BACKGROUND OF THE INVENTION

1. Field of the Invention

The present invention relates to an improved hand gripping device and, more particularly, to a hand gripping device having an interior, tubular configuration for sliding the device onto the handles of sporting equipment, e.g., golf clubs, tennis rackets, or the like. The hand gripping device has a specific shape for enabling the athlete to lightly grasp the handle of the device with the ring and little fingers.

2. Description of the Invention

Various types of hand gripping devices for use with the handles of sporting equipment such as golf clubs or tennis rackets are known in the art. Such hand gripping devices or specific handles contain a plurality of grooves, for example, five grooves for mating with the five fingers to enable one to tightly grip the piece of equipment with the fingers.

Such conventional gripping devices suffer from a number of problems. For example, since the devices have a plurality of grooves, it is complicated in structure, expensive to manufacture, ugly in appearance, and weak in material quality. Also, it does not have a strong grasping power because such conventional grip devices are based on the gripping power of the five fingers. In other words, such conventional gripping devices are not based on the power generated from the ring and little fingers, and thus such devices cannot provide power generated by only the above-mentioned two fingers. Such conventional gripping devices are shown in U.S. Pat. No. 2,200,626 to Lamkin, U.S. Pat. No. 3,868,110 to Jones, U.S. Pat. No. 4,174,109 to Gaiser, U.S. Pat. No. 4,836,544 to Lai, U.S. Pat. No. 4,934,024 to Sexton, and U.S. Pat. No. 5,294,117 to Huang.

SUMMARY OF THE INVENTION

Accordingly, it is an object of the present invention to provide an improved hand gripping device which eliminates the above problems encountered in connection with conventional hand gripping devices.

Another object of the present invention is to provide a tubular attachment having a specific shape for sliding onto a handle of the golf club, a tennis racket, or a tool handle, so as to enable the user to tightly grasp the tubular attachment by the ring and little fingers, from which fingers the strongest gripping power can be generated.

A further object of the present invention is to provide a hand gripping device which includes a tapered tubular sleeve body member and a pair of peaks extending from the body member, which resemble a camel back, wherein the rear peak is higher than the front peak, and the two peaks form two indentations, whereby the ring and little fingers can tightly conform to the indentations for providing a strong gripping power.

Still another object of the present invention is to provide a hand gripping device which is simple in structure, inexpensive to manufacture, durable in use, and refined in appearance.

Other objects and further scope of applicability of the present invention will be come apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention is directed to a detachable hand gripping device, having ring and little finger indentations, for receiving the ring and little fingers so as to provide a strong gripping power.

BRIEF DESCRIPTION OF THE DRAWINGS

The present invention will become more fully understood from the detailed description given hereinbelow and the accompanying drawings which are given by way of illustration only and, thus, are not limitative of the present invention, and wherein.

DETAILED DESCRIPTION OF THE PREFERRED EMBODIMENTS

Figure 1:
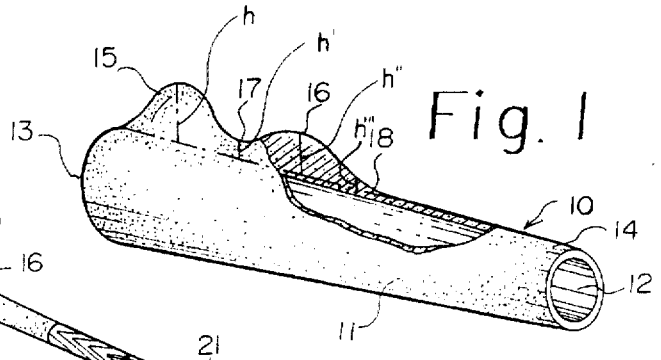
FIG. 1 is a perspective view of a hand grip device according to the present invention.

Referring now, in detail, to the drawings for the purpose of illustrating preferred embodiments of the present invention, the hand gripping device comprises a hollow, molded element, as shown in FIG. 1, which includes a tapered gripping body 11, a tapered hollow channel 12 adapted to fit conventional handles for golf clubs, tennis rackets, or the like, and a camel-back-shaped undulating surface extending from the gripping body 11 and configured to mate with the ring and little fingers so as to provide a strong gripping power.

Figure 5:
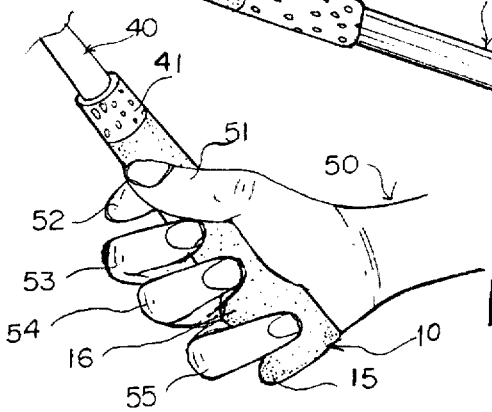
FIG. 5 is a perspective view of a user grasping a hammer handle according to the present invention.

The camel-back-shaped surface extending from the gripping body 11 includes a back peak 15, a front peak 16, a back indentation 17, such as a groove, and a front indentation 18, such as a slope, for tightly receiving the little finger 55 and the ring finger 54 of the hand 50 (FIG. 5).

As shown in FIG. 1, the gripping body 11 is provided with a traction-type surface 14 and a back end 13 which can be opened or closed, for utilization with a conventional handle for tennis rackets and tools including those which have an annular raised end.

The gripping body 11, containing the camel-back shape, is made of rubber or plastic which is stable and relatively rigid at normal abient temperature. The material of the gripping body 11 containing the camel-back shape should be semi-rigid, having a stiffness in about 700 to 1500 psi range. If the material is too hard, the coefficient of friction and the resulting gripping power will be reduced. If the material is too soft, it will have poor durability.

The heights h, h', h" and h'" of the pair of back and front peaks 15 and 16, and the pair of back and front indentations 17 and 18, have the following proportional relationship: 10:5:7:3, respectively. For example, generally, the heights h, h', h", and h'" of the back and front peaks 15 and 16, and the back and front indentations 17 and 18, are about 0.5 inches, 0.3 inches, 0.4 inches, 0.2 inches, respectively (FIG. 1). However, the heights h, h', h", and h'" of the peaks 15 and 16, and the indentations 17 and 18, can be changed depending on the size of the user's fingers.

Generally, as shown in FIG. 5, when the hand 50 grasps the gripping handle for golf clubs, tennis rackets, implements, or the like, the ring finger 54 and the little finger 55 function as the leading fingers for establishing the gripping power for all of the fingers, such as the thumb 51, the index finger 52, the middle finger 53, the ring finger 54 and the little finger.

Figure 2:
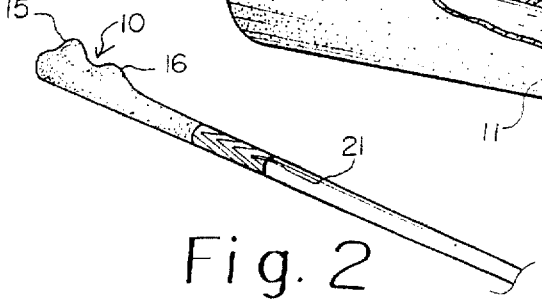
FIG. 2 is a perspective view of the hand grip device according to the present invention attached to a golf club.

The hand grip device 10, according to the present invention, is utilized as follows:

As shown in FIG. 2, for example, the hand grip attachment 10 is tightly slid onto a handle 21 of a golf club 20. At this time, the pair of peaks 15 and 16 are disposed on the opposite side of a golf club head 22. That is, the peak portion is located under the handle 21.

Accordingly, when the golf player hits a golf ball (not shown), the ring and little fingers 54 and 55 (FIG. 5) securely fit into the back indentation 17 and the front indentation 18, and thus these two fingers 54 and 55 provide a strong gripping power for controlling the golf club swing to accurately hit the golf ball.

Figure 3:
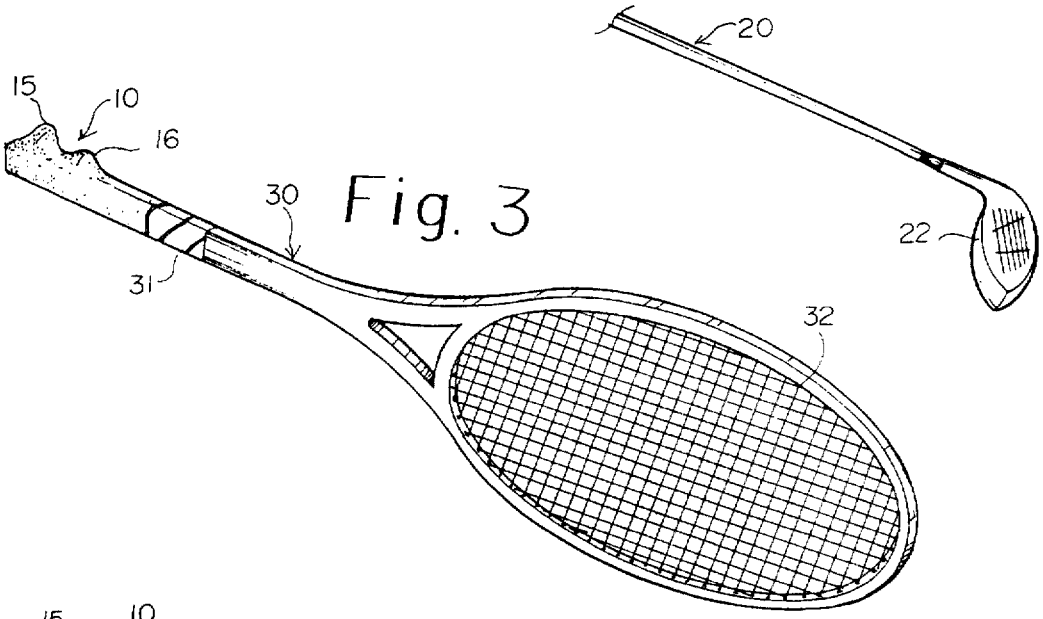
FIG. 3 is a perspective view of the hand grip device according to the present invention attached to a tennis racket.

As shown in FIG. 3, the hand grip attachment 10, according to the present invention, is utilized with a conventional tennis racket 30. That is, the gripping body 11 is firmly slid onto a handle 31 of the tennis racket 30. At this time, the pair of peaks 15 and 16 are located under the handle 31 of the tennis racket 30. Therefore, when the tennis player hits a tennis ball (not shown), the ring and little fingers 54 and 55 (FIG. 5) securely fit into the back indentation 17 and the front indentation 18, and thus these two fingers 54 and 55 provide a strong gripping power for controlling the tennis racket swing to accurately hit the tennis ball.

Figure 4:
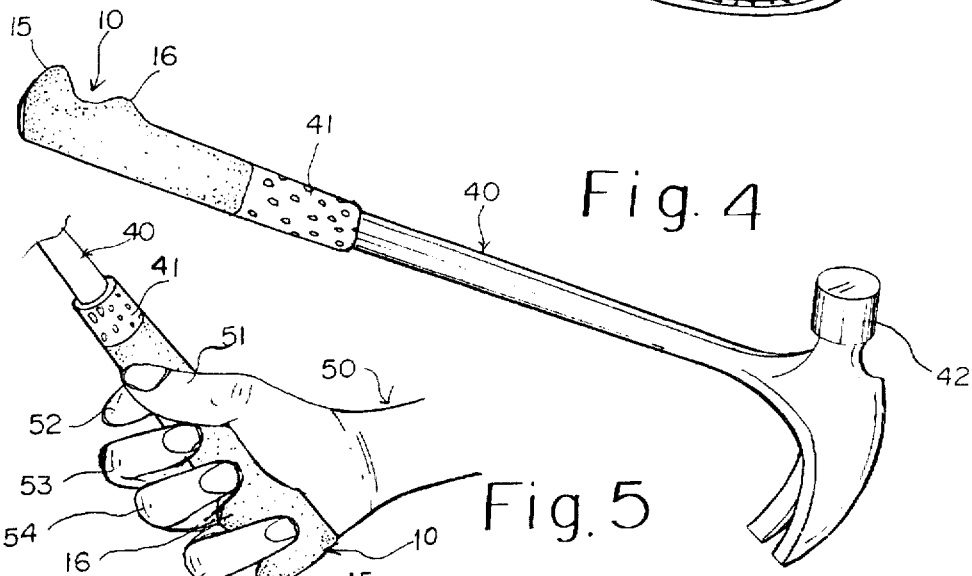
FIG. 4 is a perspective view of a hand grip device according to the present invention attached to a hammer.

As shown in FIGS. 4 and 5, the hand grip attachment 10, according to the present invention, is tightly slid onto the handle 41 of a claw hammer 40. At this time, the pair of peaks 15 and 16 are located on the same side of the claw hammer 40 as the striking head. Accordingly, when the user hits an object such as a nail or the like (not shown), the ring and little fingers 54 and 55 of the user, which fit into the indentations 17 and 18, provide a strong gripping power, whereby the striking head 42, can accurately hit the object.

Accordingly, the hand grip device 10 of the present invention, is simple in structure, inexpensive to manufacture, durable in use, and refined in appearance.

Although the hand gripping device of the present invention is in the shape of a sleeve, and thus removable, it is readily apparent that the entire handle of the golf club, hammer, etc., can be molded with the same configuration as that of the sleeve, thereby making the gripping device a permanent part of the handle.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A hand gripping device for attachment to an implement which comprises:

a hollow sleeve having an open end and an opposite end, said hollow sleeve having an inner surface and an outer surface, said inner surface being adapted to conform to the implement, said outer surface having two peaks extending from the sleeve, a first of said two peaks being located adjacent said opposite end and a second of said two peaks being located adjacent said first peak, said first and second peaks forming a valley and a slope, said valley being located between said first and second peaks and said slope being located on a side of said second peak opposite said first peak, a substantially planar section being located beside said slope on a side of said slope opposite said second peak, whereby when the sleeve is grasped by a hand, the little finger is held in said valley, the ring finger is held against said slope, and the remaining fingers are held against said substantially planar section.

2. The hand gripping device of claim 1, wherein the two peaks are positioned as front and rear peaks, with the rear peak extending from the sleeve a greater distance than the front peak.

3. The hand gripping device of claim 2, wherein the first peak, valley, second peak, and slope have the following proportional relationship: 10:5:7:3, respectively, as measured from the inner surface.

4. The hand gripping device of claim 2, wherein said opposite end is a closed end.

5. The hand gripping device of claim 2, wherein said opposite end is an open end.

6. The hand gripping device of claim 2, wherein the first peak extends in a first direction which is substantially perpendicular to a longitudinal axis of the sleeve, the second peak extends in a second direction which is substantially perpendicular to the longitudinal axis of the sleeve, and the first direction and second directions are substantially parallel.

7. The hand gripping device of claim 6, wherein the outer surface of the sleeve on a side of the sleeve opposite the first and second peaks is substantially planar along a direction of the longitudinal axis of sleeve.

8. The hand gripping device of claim 7, wherein said opposite end is an open end.

9. The hand gripping device of claim 1, wherein the first peak, valley, second peak, and slope have the following proportional relationship: 10:5:7:3, respectively, as measured from the inner surface.

10. The hand gripping device of claim 9, wherein said opposite end is a closed end.

11. The hand gripping device of claim 9, wherein said opposite end is an open end.

12. The hand gripping device of claim 1, wherein the first peak, valley, second peak, and slope have the following dimensions: 0.5, 0.3, 0.4, and 0.2 inches, respectively, as measured from the inner surface.

13. The hand gripping device of claim 1, wherein said opposite end is a closed end.

14. The hand gripping device of claim 1, wherein said opposite end is an open end.

15. The hand gripping device of claim 1, wherein said gripping device is made of an elastic material.

16. The hand gripping device of claim 15, wherein the elastic material is rubber or plastic.

17. The hand gripping device of claim 16, wherein the elastic material has a stiffness of about 900 to 1500 psi.

18. The hand gripping device of claim 15, wherein the elastic material has a stiffness of about 900 to 1500 psi.

19. The hand gripping device of claim 1, wherein the first peak extends in a first direction which is substantially perpendicular to a longitudinal axis of the sleeve, the second peak extends in a second direction which is substantially perpendicular to the longitudinal axis of the sleeve, and the first direction and second directions are substantially parallel.

20. The hand gripping device of claim 19, wherein the outer surface of the sleeve on a side of the sleeve opposite the first and second peaks is substantially planar along a direction of the longitudinal axis of sleeve.

* * * * *